US007358430B2

(12) United States Patent
Tambara

(10) Patent No.: US 7,358,430 B2
(45) Date of Patent: Apr. 15, 2008

(54) STRAP ATTACHMENT MEMBER

(75) Inventor: Yoshihiko Tambara, Iwata (JP)

(73) Assignee: Yamaha Corporation, Hamamatsu-shi (JP)

( * ) Notice: Subject to any disclaimer, the term of this patent is extended or adjusted under 35 U.S.C. 154(b) by 203 days.

(21) Appl. No.: 11/209,763

(22) Filed: Aug. 24, 2005

(65) Prior Publication Data

US 2006/0054002 A1 Mar. 16, 2006

(30) Foreign Application Priority Data

Sep. 14, 2004 (JP) ..... 2004-266354

(51) Int. Cl.
*G10D 3/00* (2006.01)

(52) U.S. Cl. ..... 84/327; 411/913

(58) Field of Classification Search ..... 411/913
See application file for complete search history.

(56) References Cited

U.S. PATENT DOCUMENTS 1,516,975 A * 11/1924 McArthur ..... 403/268
1,690,124 A * 11/1928 McArthur ..... 403/276
1,726,362 A * 8/1929 Orsenigo ..... 403/297
2,817,620 A * 12/1957 Brown et al. ..... 156/294
3,199,398 A * 8/1965 Tibor ..... 411/80.1
3,494,244 A * 2/1970 Wayland ..... 411/510
3,516,324 A * 6/1970 Berner ..... 411/72
3,705,442 A * 12/1972 Sygnator ..... 24/573.09
3,882,576 A * 5/1975 Kanno ..... 24/658
3,894,464 A * 7/1975 Brooks ..... 84/327
3,935,782 A * 2/1976 O'Brien ..... 84/743
4,014,240 A * 3/1977 Pullen ..... 84/327
4,144,794 A * 3/1979 Silverman et al. ..... 84/327
4,147,444 A * 4/1979 Herb et al. ..... 405/259.3
4,187,590 A * 2/1980 Harris et al. ..... 24/453
4,274,181 A * 6/1981 Schaller ..... 24/656

(Continued)

FOREIGN PATENT DOCUMENTS

JP 1-57797 U 4/1989

OTHER PUBLICATIONS

Ford, Frank, "De-installing an Endpin Jack," c. Oct. 10, 2000, http://www.frets.com/FRETSPages/Luthier/Technique/Guitar/Structural/NewEndWedge/d28endwedge.html.*

(Continued)

*Primary Examiner*—Lincoln Donovan
*Assistant Examiner*—Robert W Horn
(74) *Attorney, Agent, or Firm*—Smith Patent Office

(57) ABSTRACT

An attachment member for a strap for a guitar includes a shaft-shaped member fixable inside a hole in a guitar body via an adhesive agent; and a holding member continuous with this shaft-shaped member which is positioned outside the hole. The shaft-shaped member includes a first shaft-shaped portion on a distal end side of the member, a second shaft-shaped portion on a base portion side of the member, and a dividing groove formed in the first and second shaft-shaped portions. The first shaft-shaped portion contacts the hole inner circumferential surface. The second shaft-shaped portion forms a space between itself and the hole inner circumferential surface for containing the adhesive agent. When inserted, the first shaft-shaped portion is deformed in conformity with the hole internal surface configuration while narrowing the groove width of the diving groove. A shaft-shaped member can be firmly and easily fixed inside a hole.

2 Claims, 5 Drawing Sheets

U.S. PATENT DOCUMENTS

| | | | | | |
|---|---|---|---|---|---|
| 4,291,822 | A * | 9/1981 | Simonds | 224/257 |
| 4,356,987 | A * | 11/1982 | Schmid | 248/73 |
| 4,405,272 | A * | 9/1983 | Wollar | 411/41 |
| 4,802,700 | A * | 2/1989 | Stevenson et al. | 292/327 |
| 4,901,900 | A * | 2/1990 | Goto | 224/257 |
| 5,037,234 | A * | 8/1991 | De Jong | 403/268 |
| 5,547,322 | A * | 8/1996 | Lilja et al. | 411/80.5 |
| 5,615,462 | A * | 4/1997 | Goto | 24/608 |
| 5,658,086 | A * | 8/1997 | Brokaw et al. | 403/327 |
| 5,931,619 | A * | 8/1999 | Hartmann | 411/54 |
| 6,158,934 | A * | 12/2000 | Wieland | 411/80.1 |
| 6,254,301 | B1 * | 7/2001 | Hatch | 403/298 |
| 6,345,946 | B1 * | 2/2002 | Mainini et al. | 411/508 |
| 6,575,681 | B2 * | 6/2003 | Kojima et al. | 411/508 |
| 6,665,914 | B2 * | 12/2003 | Ogawa | 24/297 |
| 6,855,879 | B2 * | 2/2005 | Minakuchi et al. | 84/327 |
| 7,082,650 | B2 * | 8/2006 | Awakura et al. | 24/458 |
| 2006/0054002 | A1 * | 3/2006 | Tambara | 84/327 |

OTHER PUBLICATIONS

Ford, Frank, "Installing Strap Buttons," c. Mar. 13, 1998, http//www.frets.com/FRETSPages/Musician/GenSetup/StrapButton/strapbutton1.html,/strapbutton2.html,/strapbutton3.html.*

* cited by examiner

STRAP ATTACHMENT MEMBER

BACKGROUND OF THE INVENTION

1. Field of the Invention

Priority is claimed on Japanese Patent Application No. 2004-266354, filed Sep. 14, 2004, the contents of which are incorporated herein by reference.

The present invention relates to a strap attachment member. More specifically, the present invention relates to a strap attachment member that can be easily and firmly fitted into a hole that is formed in an outer surface side of a musical instrument.

2. Description of Related Art

Conventionally, when playing a guitar, a strap that is looped over the player's shoulder is widely used. One end of this strap is attached via an attachment member to a rear portion of the guitar body (see Japanese Utility Model Application Unexamined Publication No. 1-57797). As is shown in FIG. 5 and FIG. 6A, as this type of attachment member, for example, a pin type of attachment member 50 is known that protrudes from a rear surface side (i.e., the left surface side in the figures) of a body 52 of the guitar 51.

In these figures, an attachment member 50 is constructed having a shaft-shaped member 54 that is formed in a tapered shape that gradually narrows towards its distal end and is inserted into a hole 52A that is formed in the body 52, and having a holding portion 55 that is positioned at an outer side of the body 52 continuing on from the shaft-shaped member 54 and that is provided with a circumferential groove 55A around which is hooked one end of the strap (not shown).

However, the area where the hole 52A is formed in the body 52 of the guitar 51 is made of wood, and in many cases the working of the hole 52A is done using a drill. Because of this, errors may occur in the diametrical dimensions of the hole 52A due to the direction of the wood grain or to changes in humidity as well as to the effects of the condition of the drill blade and the like. If the error is such that the diametrical dimensions of the hole 52A are too small, then the shaft-shaped member 54 is not completely inserted inside the hole 52A (see FIG. 6B).

Moreover, because the shaft-shaped member 54 is formed in a tapered shape, the contact area between the shaft-shaped member 54 and the inner circumferential surface of the hole 52A is narrowed and the strength by which the attachment member 50 is fixed in place is reduced. Consequently, there is a strong possibility of the shaft-shaped member 54 becoming disengaged from the hole 52A. As a result, during a performance when the strap is hung over the player's shoulder, there is a possibility of the guitar 51 inadvertently falling and of the body 52 and the like being damaged.

Here, in order to increase the strength by which the attachment member 50 is fixed in place, increasing the amount of adhesive agent that is used might be considered, however, in this case, as is shown in FIG. 6C, there is a tendency for the adhesive agent to be squeezed onto the external surface side of the body 52. Accordingly, the contrasting problems are often created of it being necessary to perform the difficult task of fixing the attachment member 20 in place while at the same time avoiding such adhesive agent overflows in order to avoid any fouling to the external surface of the body 52.

The present invention has been made in view of the above described problems and it is an object thereof to provide a strap attachment member that enables its shaft-shaped member to be firmly fixed in a hole and that also enables this fixing operation to be performed easily.

SUMMARY OF THE INVENTION

In order to achieve the above described object, according to the present invention, there is provided an attachment member for attaching a predetermined strap to an external surface of a musical instrument, including a shaft-shaped member that is inserted inside a hole formed in the external surface of the musical instrument and is fixed inside the hole via an adhesive agent; and a holding member for holding the strap that is continuous with the shaft-shaped member and is positioned on an exterior side of the hole, the shaft-shaped member comprising: a first shaft-shaped portion that is positioned on a distal end side of the shaft-shaped member and is placed in contact with an inner circumferential surface of the hole; a second shaft-shaped portion that is positioned on a base portion side of the shaft-shaped member and that forms a space between itself and the inner circumferential surface of the hole where the adhesive agent is contained; and a dividing groove that is formed in the first and second shaft-shaped portions, wherein when the shaft-shaped member is inserted into the hole, the first shaft-shaped portion is deformable in conformity with an internal surface configuration of the hole while narrowing a groove width of the dividing groove.

In the present invention, it is preferable that the first shaft-shaped portion has an area that is formed in a substantially circular column shape or a substantially circular cylinder shape, while the second shaft-shaped portion is formed in a tapered shape whose diameter gradually narrows as it approaches the first shaft-shaped portion, and that a maximum diameter of the second shaft-shaped portion is set substantially equal to or slightly smaller than a diameter of the first shaft-shaped portion.

Moreover, a structure is also preferably employed in which the second shaft-shaped portion is formed in a tapered shape whose diameter gradually narrows as it approaches the first shaft-shaped portion, and a maximum diameter of the second shaft-shaped portion is set substantially equal to or slightly smaller than a diameter of the hole.

According to the present invention, even if an error arises in which the hole diameter is too small, it is still possible to prevent the shaft-shaped member from being incompletely inserted into the hole. More specifically, when the shaft-shaped member is inserted inside the hole, most of the area of the second shaft-shaped portion can be kept out of contact with the inner circumferential surface of the hole, while the first shaft-shaped portion can be deformed so as to contract in the radial direction of the hole via the dividing groove, and be placed in contact with the inner surface of the hole. As a result, the entire shaft-shaped member can be inserted inside the hole.

Moreover, because an adhesive agent is contained in a space formed between the second shaft-shaped portion and the inner circumferential surface of the hole, by applying a comparatively small amount of adhesive agent to the inner circumferential surface of the hole, the adhesive agent can be kept contained inside this space. As a result, it is possible to prevent the adhesive agent from being squeezed outside the hole and the task of fixing the attachment member in place is simplified. In addition, the adhesive agent is able to more easily exhibit its adhesive strength and the strength with which the shaft-shaped member is fixed in the hole can be consistently maintained.

Furthermore, because the maximum diameter of the second shaft-shaped portion is set at substantially the same as or slightly smaller than the diameter of the first shaft-shaped portion or than the diameter of the hole, not only the first shaft-shaped portion, but the second shaft-shaped portion also is partially in contact with the inner circumferential surface of the hole. As a result, an area in which the adhesive agent can be contained is secured, while the shaft-shaped member is in contact with the inner circumferential surface of the hole in two locations in the axial direction. Consequently, the strength with which the shaft-shaped member is fixed in place can be further increased. Moreover, because the first shaft-shaped portion includes areas that are formed in a substantially circular column shape or in a substantially circular cylinder shape, the inner circumferential surface of the hole and the external surface of the first shaft-shaped portion are substantially in surface contact for a certain width in the axial direction. This fact as well makes it possible for the fixing strength to be increased. Accordingly, any falling out of the shaft-shaped member, as occurs conventionally, can be prevented and damage to a musical instrument during a performance can be avoided.

Note that, within the range of the specification and the claims, the term "shaft-shaped member" is used as a definition to include not only solid members, but also hollow members such as pipes.

BRIEF DESCRIPTION OF THE DRAWINGS

FIG. 6A is a cross-sectional view similar to FIG. 3 showing the conventional attachment member, while

DETAILED DESCRIPTION OF THE INVENTION

A preferred embodiment of the present invention will now be described with reference made to the drawings.

Figure 1:
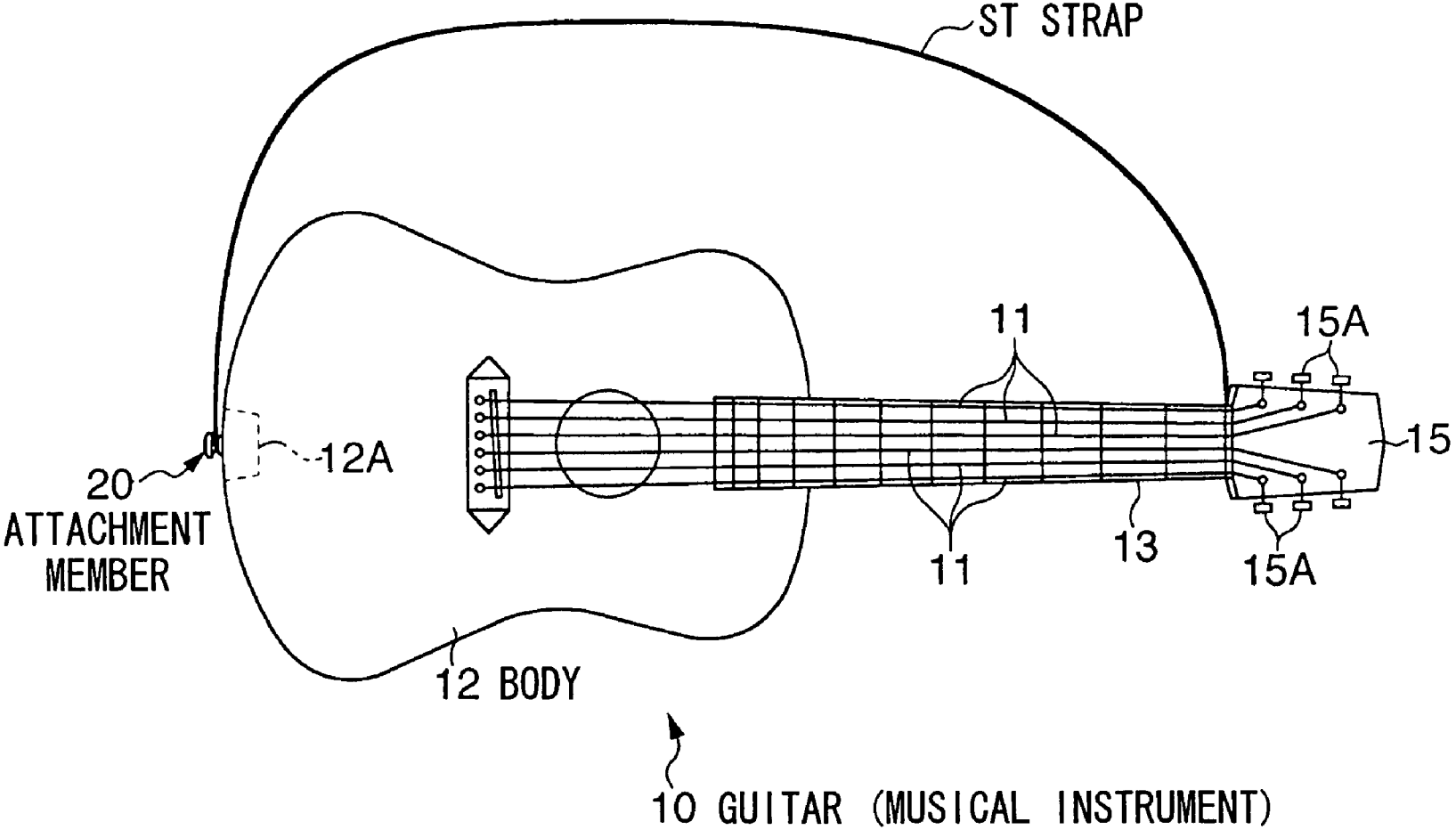
FIG. 1 is a frontal view of a guitar to which the attachment member of an embodiment of the present invention has been applied.

FIG. 1 is a schematic frontal view of a guitar in which the attachment member of an embodiment of the present invention has been used. In FIG. 1, a guitar 10, which serves as a musical instrument, is an acoustic type of guitar and is formed mainly from wood. The guitar 10 is provided with a body 12 that supports one end (i.e., the left end side in FIG. 1) of a plurality of strings 11, a neck 13 that is joined to the body 12, and a box section 15 that is provided at the right end side as seen in FIG. 1 of the neck 13 and includes tuning keys 15A around which are wound the other ends of the strings 11. A strap ST that is formed in a belt shape and is looped over the shoulder of a player is attached to the guitar 10. The right end side as seen in FIG. 1 of this strap ST is attached between the neck 13 and the box 15. In contrast, the left end side as seen in FIG. 1 of the strap ST is attached to the guitar 10 via an attachment member 20 that protrudes from a rear surface (i.e., the left surface as seen in FIG. 1) of the body 12.

Figure 2:
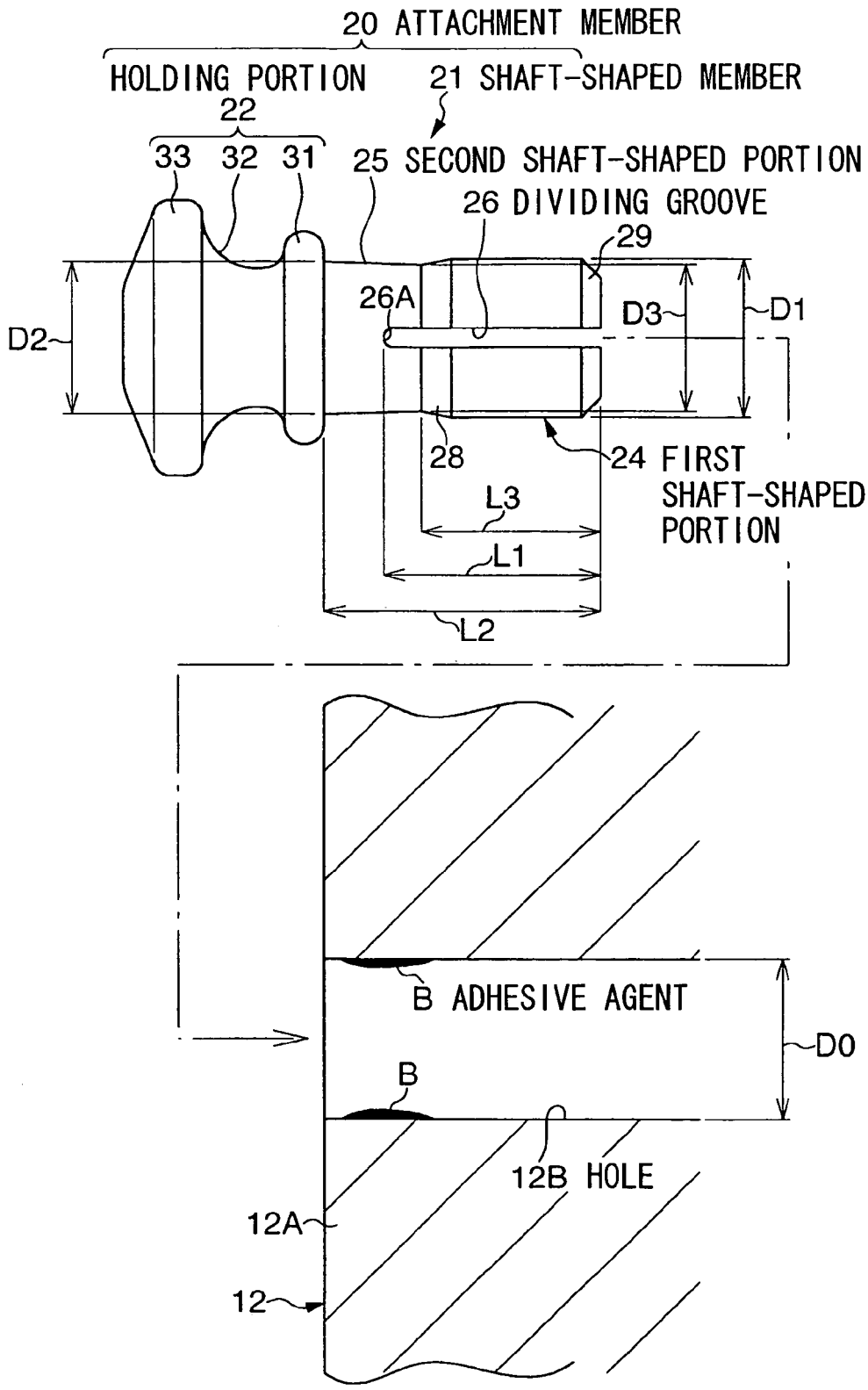
FIG. 2 is an exploded view of FIG. 3.

As is shown in FIG. 1 and FIG. 2, the attachment member 20 is fixed via an adhesive agent B in a hole 12B that is formed in a block-shaped portion 12Ab that is located in a rear portion of the body 12. Here, the block-shaped portion 12A is not particularly restricted, however, in the present embodiment it is constructed using a wood-based material. Moreover, the hole 12B is formed so as to penetrate the block-shaped portion 12A in the left—right direction as seen in FIG. 2, and is formed using a drill or the like as a circular hole having a diameter of D0. The cross-sectional configuration of the hole 12B in the radial direction is substantially the same along the direction in which the hole 12B extends.

Figure 3:
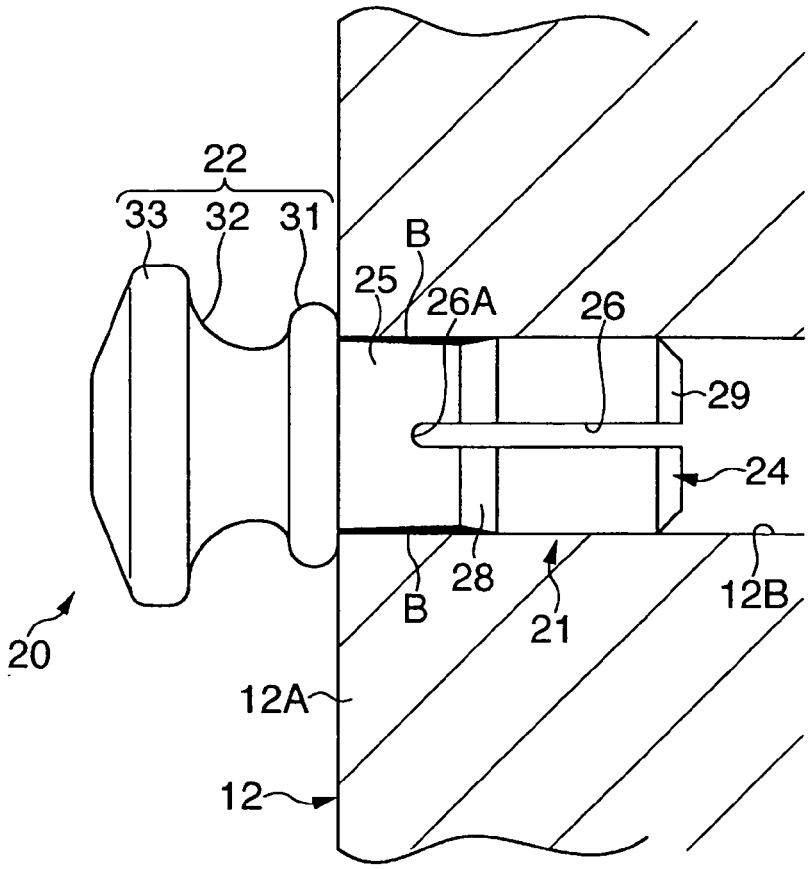
FIG. 3 is an enlarged front cross-sectional view of a main portion of FIG. 1.

In the present embodiment, the attachment member 20 is formed by a component that has been molded as a single body using a resin material such as ABS. As is shown in FIGS. 2 and 3, the attachment member 20 is inserted into the hole 12B, and is provided with a shaft-shaped member 21 that is fixed inside the hole 12B via the adhesive agent B and with a holding portion 22 that is positioned on the outside of the hole 12B and is joined to the shaft-shaped member 21.

The shaft-shaped member 21 is formed by a first shaft-shaped portion 24 that is positioned on the distal end side (i.e., on the right side in FIG. 2) thereof, a second shaft-shaped portion 25 that is positioned on the base portion side (i.e., on the left side in FIG. 2) thereof, and a dividing groove 26 that is formed in the first and second shaft-shaped portions 24 and 25.

The first shaft-shaped portion 24 is formed substantially as a circular column having tapered surface portions 28 and 29 on both sides in the axial direction thereof. Apart from the areas where the tapered surface portions 28 and 29 are formed, the cross-sectional configuration in the radial direction of the first shaft-shaped portion 24 is set as a substantially circular shape having a diameter D1.

The second shaft-shaped portion 25 is provided between and is also continuous with the first shaft-shaped portion 24 and the holding portion 22, and is formed in a tapered shape whose diameter gradually narrows as it approaches the first shaft-shaped portion 24 side. The second shaft-shaped portion 25 has a maximum diameter D2 at a position where it joins with the holding portion 22, and has a minimum diameter D3 at a position where it joins with the first shaft-shaped portion 24.

Figure 4:
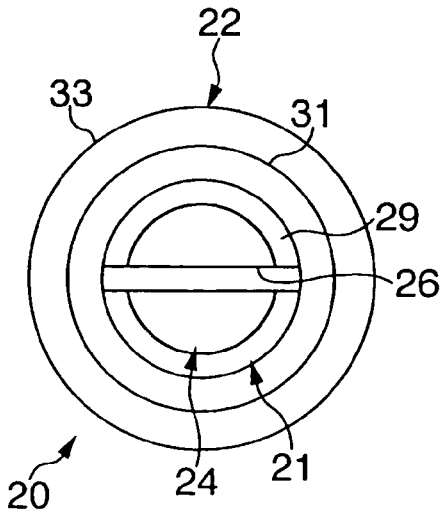
FIG. 4 is a right side view of the attachment member.
Figure 5:
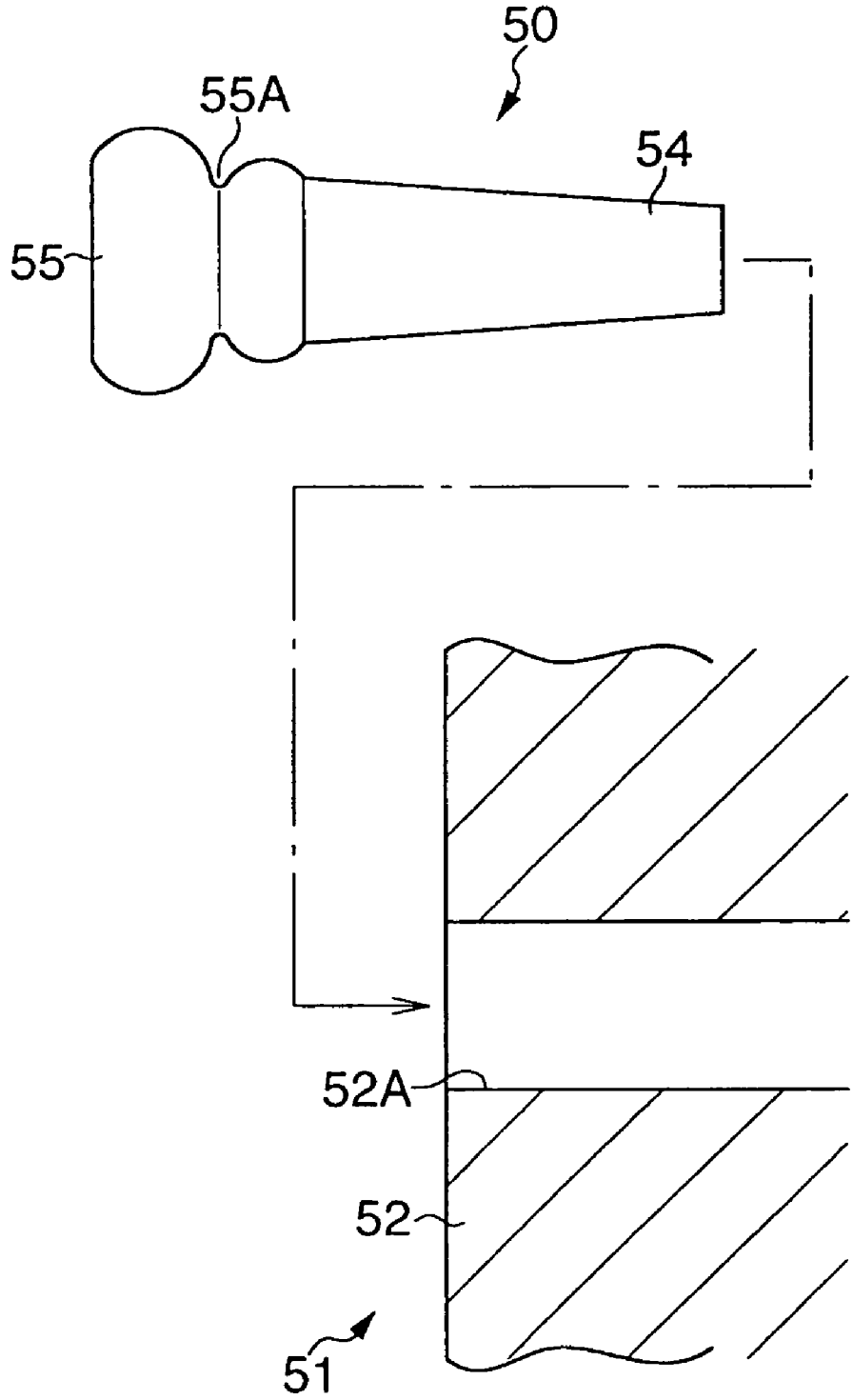
FIG. 5 is an exploded view similar to FIG. 2 showing a conventional attachment member.
Figure 6A:
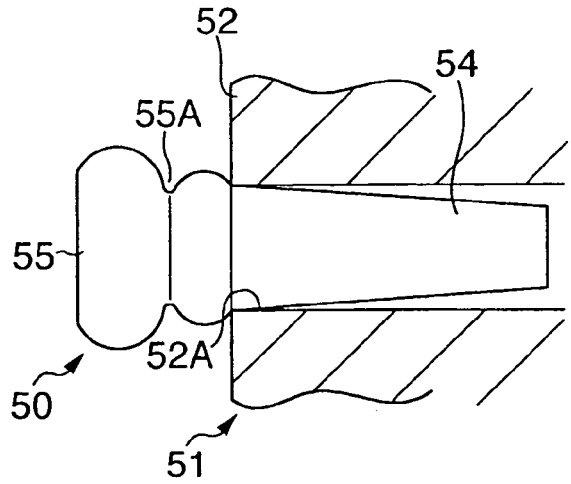
Figure 6B:
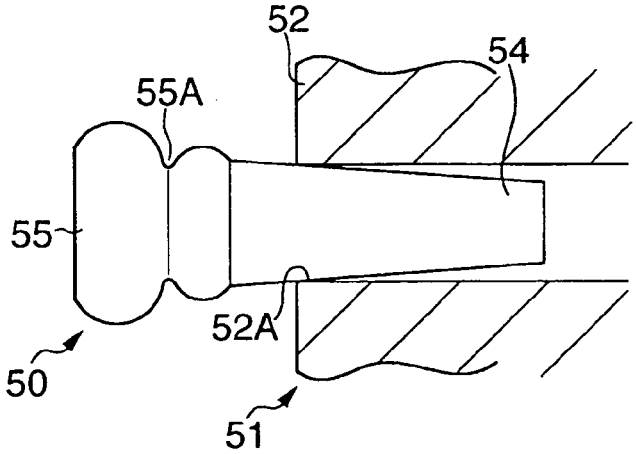
FIGS. 6B and 6C are explanatory views showing a state in which the conventional attachment member is attached.
Figure 6C:
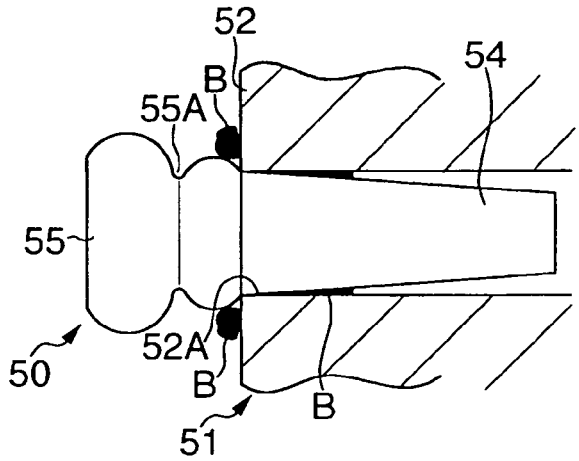

The dividing groove 26 extends in a diameter position of the shaft-shaped member 21 (see FIG. 4), and is also formed so as to be hollowed out in the axial direction from the distal end of the shaft-shaped member 21 towards the base portion thereof (i.e., from the right side towards the left side in FIG. 2). A bottom portion 26A of the dividing groove 26 is positioned within the area of the second shaft-shaped portion 25. As a result, the first shaft-shaped portion 24 is formed so as to be elastically deformable overall such that, if external force is applied in the direction in which the diameter of the first shaft-shaped portion 24 becomes narrower, then the groove width of the dividing groove 26 is narrowed.

The holding portion 22 is provided so as to be able to catch and hold an end portion of the strap ST. The holding portion 22 is seated on a rear surface of the body 12 (i.e., the left side surface as seen in FIG. 2), and is provided with a disk-shaped seat portion 31 whose diameter dimension is greater than the maximum diameter D2 of the second shaft-shaped portion 25, a circumferential groove portion 32 that is continuous with the left side (as seen in the figure) of the seat portion 31 and extends in a circumferential direction and that receives the end portion of the strap ST, and a disk-shaped head portion 33 that is continuous with the left side (as seen in the figure) of the circumferential groove portion 32 and whose diameter dimension is greater than that of the seat portion 31.

Here, a more detailed description will be given concerning the size of the shaft-shaped member 21.

It is desirable that the diameter D1 of the first shaft-shaped portion 24 is approximately 100 to 102.5% of the diameter D0 of the hole 12B. By employing such a structure, the first shaft-shaped portion 24 is substantially in tight contact with the inner circumferential surface of the hole 12B and is able to be placed in a state of pressure contact by being elastically deformed. Accordingly, the shaft-shaped member 21 can be reliably fixed inside the hole 12B. Note that, in the present embodiment, the diameter D1 is set at approximately 8.1 mm, while the diameter D0 is set at approximately 8.0 mm.

The maximum diameter D2 of the second shaft-shaped portion 25 may be set at substantially the same as or at slightly smaller than the diameter D0 of the hole 12B, and, specifically, it is desirable that it is approximately 97% to 100% of the diameter D0 of the hole 12B. Namely, it is desirable that the maximum diameter D2 of the second shaft-shaped portion 25 is set at substantially the same as or at slightly smaller than the diameter D1 of the first shaft-shaped portion 24. By employing such a structure, the aperture side of the hole 12B (i.e., the left side in FIG. 3) is substantially in contact with the area of the maximum diameter D2 of the second shaft-shaped portion 25, and it is possible to prevent the axis of the shaft-shaped member 21 from wobbling and being skewed off-center while enabling the seat portion 31 to remain reliably seated at the outer surface of the body 12.

It is desirable that the minimum diameter D3 of the second shaft-shaped portion 25 is approximately 85% to 95% of the diameter D0 of the hole 12B. By employing such a structure, a space is secured that houses the adhesive agent B between the circumferential surface of the second shaft-shaped portion 25 and the inner circumferential surface of the hole 12B such that the adhesive agent B is not squeezed out from the hole 12B. In addition, the strength in the vicinity of the minimum diameter D3 is maintained.

The depth L1 in the axial direction of the dividing groove 26 is preferably approximately 70% to 85% of the length L2 in the axial direction of the shaft-shaped member 21. The length L3 in the axial direction of the first shaft-shaped portion 24 is preferably approximately 60% to 75% of the depth L1 in the axial direction of the dividing groove 26. By employing such a structure, even if errors occur in which the diameter D0 of the hole 12B is too small due to the way the drill is operated or the like, as is described above, for example, even if the diameter D0 is approximately 0.2 mm smaller than the diameter D1 of the first shaft-shaped portion 24, the shaft-shaped member 21 can still be inserted into the hole 12B.

In the above structure, when the attachment member 20 is fixed to the body 12, as is shown in FIG. 2, the adhesive agent B is first coated on the inner circumferential surface of the hole 12B and the shaft-shaped member 21 is then inserted into the hole 12B. By employing such a structure, while narrowing the groove width of the dividing groove 26, the first shaft-shaped portion 24 is elastically deformed substantially in a diameter-narrowing direction in accordance with the shape of the internal surface of the hole 12B. Consequently, the circumferential surface of the first shaft-shaped portion 24 is substantially in surface contact with the inner circumferential surface of the hole 12B.

In this state, if the shaft-shaped member 21 is further inserted inside the hole 12B while opposed by the friction resistance between the first shaft-shaped portion 24 and the inner circumferential surface of the hole 12B, then, as is shown in FIG. 3, there is substantial contact between the aperture side (i.e., the left side in FIG. 3) of the inner circumferential surface of the hole 12B and the area around the maximum diameter D2 (i.e., the left side in FIG. 3) of the second shaft-shaped portion 25. Moreover, the adhesive agent B is contained within the gap formed between the second shaft-shaped portion 25 and the internal circumferential surface of the hole 12B, and the seat portion 31 of the holding portion 22 is seated on the rear surface of the body 12.

In this state, if left for a predetermined time, the adhesive agent B hardens and the attachment member 20 is fixed inside the hole 12B.

Consequently, according to this embodiment, because the bottom portion 26A of the dividing groove 26 is positioned within the area of the second shaft-shaped portion 25, the first shaft-shaped portion 24 is elastically deformed as a whole in the hole 12B, including not only the distal end side, but also the base portion side of the first shaft-shaped portion 24. Moreover, because the second shaft-shaped portion 25 is formed in the tapered shape described above, during the insertion thereof into the hole 12B the contact between the second shaft-shaped portion 25 and the internal circumferential surface of the hole 12B is controlled so that the friction resistance between the two can be reduced. As a result, even if an error arises in which the diameter D0 of the hole 12B is too small, the shaft-shaped member 21 can be easily and smoothly inserted so as to be completely contained inside the hole 12B.

Moreover, because the adhesive agent B is concentrated inside the gap formed between the second shaft-shaped portion 25 and the internal circumferential surface of the hole 12B, the adhesive strength can be maintained even if the amount of the adhesive agent B that is used is reduced. Accordingly, the adhesive agent B can be prevented from being squeezed to the outside of the hole 12B and the attachment member 20 can be easily fixed in place. Furthermore, because not only the circumferential surface of the first shaft-shaped portion 24, but also the area on the left side (as seen in FIG. 3) of the second shaft-shaped portion 25 is in substantial contact with the internal circumferential surface of the hole 12B, the shaft-shaped member 21 makes contact with the internal circumferential surface of the hole 12B in two locations that are separate from each other in the axial direction of the shaft-shaped member 21. Consequently, the shaft-shaped member 21 is supported in a stable manner inside the hole 12B. As a result, it is possible to prevent the attachment member 20 of the guitar 10 inadvertently falling out during a performance, and it is possible to prevent damage to the body 12 and the like.

The best structure and method and the like for implementing the present invention are disclosed in the above description, however, the present invention is not limited to this description.

Namely, while specific embodiments of the invention have been described and illustrated above, it is also possible for one skilled in the art to make various modifications to the configurations, positions, materials, directions or other details of the structure of the above described embodiment without departing from the spirit and scope of the present invention.

Accordingly, because the description limiting the configuration and the like disclosed above is provided as an example in order to simplify understanding of the present invention and in no way limits the present invention, any description in the names of members excepting either a portion of the limits or all of the limits on the configuration or the like is included in the present invention. Accordingly, the invention is not to be considered as limited by the foregoing description and is only limited by the scope of the appended claims.

For example, in the structural example described above, the first shaft-shaped portion 24 is formed as a solid, substantially columnar portion, however, it may also be formed as a hollow, substantially cylindrical portion that presents substantially the same external configuration.

The material used to form the attachment member 20 may be a wooden material or may be changed to a metal provided that it allows the deformation in which the groove width of the dividing groove 26 is narrowed.

Moreover, while it is obvious that the present invention may be applied to an acoustic guitar, other musical instruments to which it may be applied include string instruments capable of reproducing electrical sounds, as well as instruments other than string instruments to which a strap is attached such as wind instruments and percussion instruments.

The present invention is used in musical instruments that use a strap during a performance.

What is claimed is:

1. An attachment member for attaching a predetermined strap to an external surface of a musical instrument, including a shaft-shaped member that is inserted inside a hole formed in the external surface of the musical instrument and is fixed inside the hole via an adhesive agent; and a holding member for holding the strap that is continuous with the shaft-shaped member and is positioned on an exterior side of the hole, said shaft-shaped member comprising:

a first shaft-shaped portion that is positioned on a distal end side of the shaft-shaped member and is placed in contact with an inner circumferential surface of the hole;

a second shaft-shaped portion that is positioned on a base portion side of the shaft-shaped member and that forms a space between itself and the inner circumferential surface of the hole where the adhesive agent is contained; and a dividing groove that is formed in said first and second shaft-shaped portions, wherein when the shaft-shaped member is inserted into the hole, the first shaft-shaped portion is deformable in conformity with an internal surface configuration of the hole while narrowing a groove width of the dividing groove, wherein said first shaft-shaped portion has an area that is formed in a substantially circular column shape or a substantially circular cylinder shape, while said second shaft-shaped portion is formed in a tapered shape whose diameter gradually narrows as it approaches the first shaft-shaped portion, and wherein a maximum diameter of the second shaft-shaped portion is set substantially equal to or slightly smaller than a diameter of the first shaft-shaped portion.

2. An attachment member for attaching a predetermined strap to an external surface of a musical instrument, including a shaft-shaped member that is inserted inside a hole formed in the external surface of the musical instrument and is fixed inside the hole via an adhesive agent; and a holding member for holding the strap that is continuous with the shaft-shaped member and is positioned on an exterior side of the hole, said shaft-shaped member comprising:

a first shaft-shaped portion that is positioned on a distal end side of the shaft-shaped member and is placed in contact with an inner circumferential surface of the hole;

a second shaft-shaped portion that is positioned on a base portion side of the shaft-shaped member and that forms a space between itself and the inner circumferential surface of the hole where the adhesive agent is contained; and a dividing groove that is formed in said first and second shaft-shaped portions, wherein when the shaft-shaped member is inserted into the hole, the first shaft-shaped portion is deformable in conformity with an internal surface configuration of the hole while narrowing a groove width of the dividing groove, wherein said second shaft-shaped portion is formed in a tapered shape whose diameter gradually narrows as it approaches the first shaft-shaped portion, and a maximum diameter of the second shaft-shaped portion is set substantially equal to or slightly smaller than a diameter of the hole.

* * * * *